United States Patent [19]

Daniel et al.

[11] 4,410,051

[45] Oct. 18, 1983

[54] SYSTEM AND APPARATUS FOR ORIENTING A WELL CASING PERFORATING GUN

[75] Inventors: Wilbur L. Daniel; Eugene J. Linyaev; Arnold M. Walkow; Gregory J. Wilkinson, all of Houston, Tex.

[73] Assignee: Dresser Industries, Inc., Dallas, Tex.

[21] Appl. No.: 238,907

[22] Filed: Feb. 27, 1981

[51] Int. Cl.[3] ..... E21B 43/117

[52] U.S. Cl. ..... 175/4.51; 175/4.56; 166/55.1

[58] Field of Search ..... 175/4.51, 4.52, 4.53, 175/4.54, 4.55, 4.56, 4.5; 166/55, 55.1, 297

[56] References Cited

U.S. PATENT DOCUMENTS 3,064,571 10/1958 True ..... 102/21.8

3,175,617 8/1958 North ..... 166/55.1

*Primary Examiner*—William F. Pate, III

*Attorney, Agent, or Firm*—Richard M. Byron

[57] ABSTRACT

A system for orienting a well casing perforating gun for utilization in wells having multiple tubing strings wherein it is desired to perforate the well casing in a zone other than the deepest production zone of the well and includes a hoist and associated apparatus for moving the perforating apparatus through the well and actuating the perforating gun. The perforating apparatus includes an elongated housing supportable on a cable, rollers on the exterior of the housing to support it on the interior of the well casing and/or tubing, the casing perforating gun, an orienting apparatus operable to orient the perforating gun relative to a string of tubing within the casing, a swivel within the housing to permit rotating motion of the lower portion of the housing relative to an upper portion of the housing, and an eccentric weight below the swivel to assist in positioning and aligning the casing perforating gun to the desired position.

16 Claims, 7 Drawing Figures

SYSTEM AND APPARATUS FOR ORIENTING A WELL CASING PERFORATING GUN

TECHNICAL FIELD

This invention relates to the orientation of casing perforating guns and the like within well casing prior to shooting the gun and thereby perforating the well casing. More particularly this invention relates to the orientation of well casing perforating guns in wells that have a multiple zone production accomplished by using multiple strings of tubing within a single well casing. The apparatus of this invention has several components that cooperatively function to permit it to be passed through one string of tubing, exit the lower end of the tubing and perforate the casing in the portion below this tubing without damaging another string of tubing passsing further down the well.

BACKGROUND OF THE INVENTION

The perforation of casing in multiple zone wells has been done for many years and typically two significant problems are encountered. The first of these problems deal with getting the perforating equipment into the proper orientation relative to a string of tubing within the zone to be perforated. This is significant because in this perforating operation it is desired to perforate the casing and not damage any other string of tubing that might be within the casing and extending to a lower zone of the well. In the event that the perforating gun is not oriented correctly when fired this results in significant damage to the string of tubing passing through the zone that is perforated thereby requiring removal of the tubing from the well and replacement of the damaged segment. This problem is more acute when perforating the casing in wells that have deviated boreholes because of the need to physically position a perforating instrument in some opposite relation to the tubing string that passes through the zone of the casing that is to be perforated.

The second significant problem arising in these perforating operations is also in conjunction with perforating wells that have deviated boreholes. Typically, in wells with deviated boreholes the tubing comprising the tubing string will tend to twist or "corkscrew" through the length of the well. This twisting of the tubing string will make it more difficult to pass a perforating gun and its associated apparatus through the tubing string due to the additional twisting and turning of the tubing. Also, because the borehole is deviated from a vertical direction the force of gravity tending to pull the equipment downward through the well is reduced from that which would be encountered in a truly vertical well. The inclination of the well alone causes the perforating gun and its associated apparatus to slide along the bottom side of the tubing thereby decreasing the ease with which it passes downward through the well. Obviously, it highly deviated boreholes the forces tending to move the perforating equipment downward can be significantly diminished thereby making it extremely difficult to place the perforating equipment within the well at the desired location.

SUMMARY OF THE INVENTION

The system of this invention includes a hoist for supporting by cable in a well a perforating apparatus along with the necessary controls to actuate the perforating gun and orientation device. The well casing perforating apparatus includes the perforating and the associated well casing perforation orientation apparatus necessary to correctly position it within the well casing and orient it relative to tubing within the well casing prior to the actual perforation.

The well casing perforation orientation apparatus includes an elongated housing connectable to the cable. The housing has a guide device at the upper end portion thereof at the cable for guiding the housing when reentering a tubing string.

A roller assembly on the housing supports it as the housing moves through the tubular interior of the well. A casing perforation orienting device within the housing is operable to orient the housing so that when the perforating gun is fired it will not be directed toward an existing tubing string within the casing. A swivel within the housing separates upper and lower portions thereof for free relative rotation. An eccentric weight within the housing below the swivel assists in orienting the housing with a top portion being upward and a bottom portion being positioned downward.

An object of this invention is to provide a system and an apparatus overcoming the aforementioned disadvantages well known in the prior art as discussed above.

Still, another object of this invention is to provide a well casing perforating system that is adapted for use in wells having multiple completions or constructed for production through multiple tubing strings contained within a single casing and which will not damage a deeper tubing string when perforating a shallower zone.

Still, another object of this invention is to provide a well perforating apparatus that is adapted for use in wells having deviated boreholes and equipped with multiple tubing strings where it is desired to perforate a shallower zone in a well that is below the lower end of the tubing string for producing from that zone.

Yet, another object of this invention is to provide oil casing perforation apparatus that is provided with rollers, a swivel, an eccentric weight and a pointer arm to assist in motion of the apparatus through the tubing and the casing of a well and the orientation of the perforating at a desired location within the well.

Still, another object of this invention is to provide a lower casing perforation apparatus that can be configured in several possible combinations to be made most suitable for passing the apparatus through the tubing and casing in a well that has a highly deviated borehole wherein the tubing thereof is turned or corkscrewed.

Various other objects, advantages, and features of this invention will become apparent to those skilled in the art from the following discussion taken in conjunction with the accompanying drawings, in which:

Figure 1:
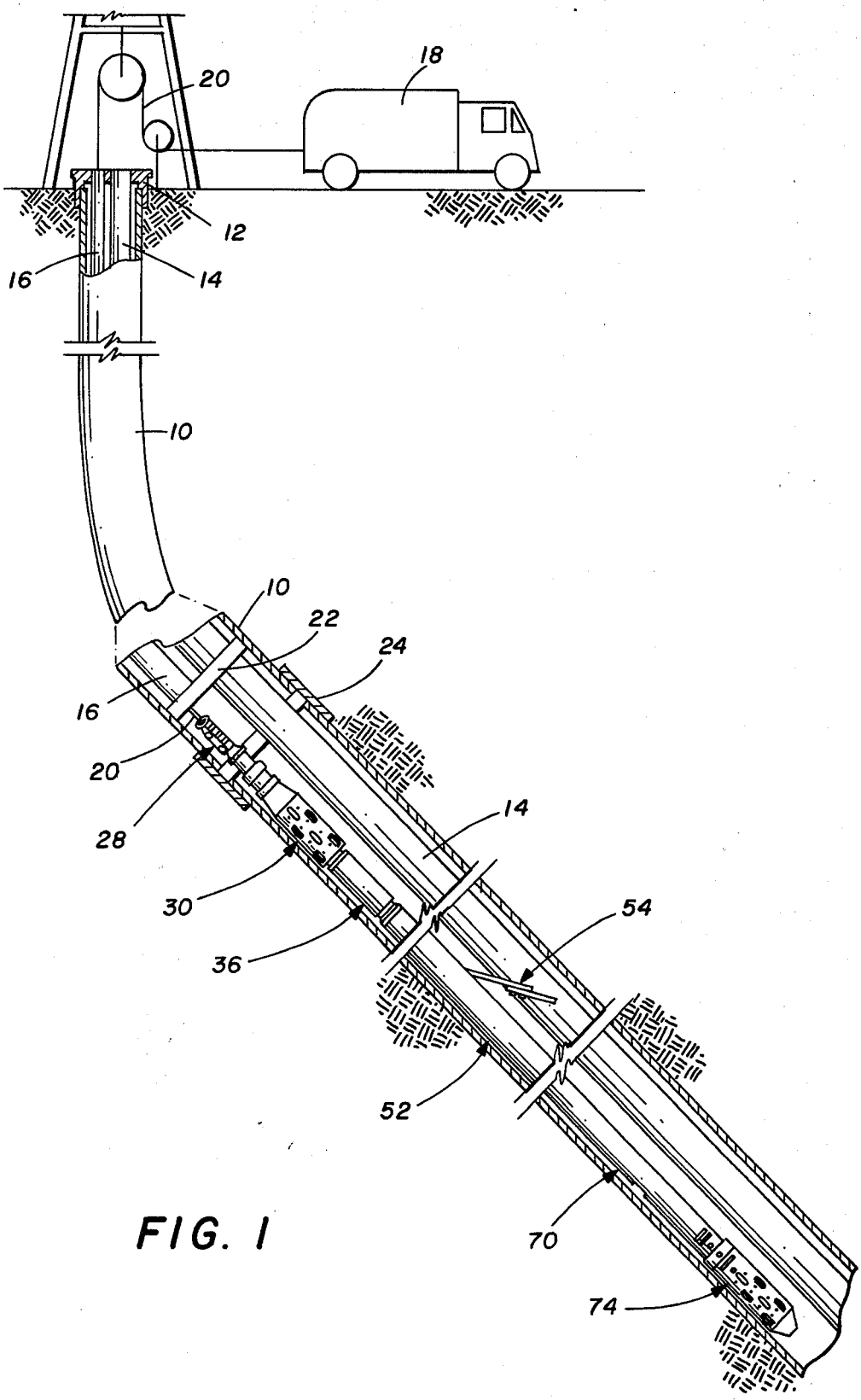
FIG. 1 is a partially sectional view of a well having a dual tubing string completion therein with the well casing perforation system of this invention being used thereon, and with the well casing perforation apparatus positioned within a cutaway section of the section.

The following is a discussion and description of preferred specific embodiments of the well casing perforation system and apparatus of this invention, such being made with reference to the drawings whereupon the same reference numerals are used to indicate the same or similar parts and/or structure. It is to be understood that such discussion and description is not to unduly the scope of the invention.

DETAILED DESCRIPTION OF THE PREFERRED EMBODIMENT

Referring to FIG. 1 of the drawings wherein it shows a well upon which a perforating operation is being performed using the perforating apparatus and system of this invention. The well includes a casing mounted within a borehole and supported by a wellhead 12 at the earth's surface. The well is constructed within a dual completion configuration wherein two strings of tubing are suspended from the wellhead within casing 10. A deeper tubing string 14 and a shallower tubing string 16 are supported from wellhead 12 and positioned in side by side relation within casing 10. The borehole of this well is illustrated as being significantly deviated from the vertical in order to illustrate the effectiveness of the apparatus of this invention. At the earth's surface, a service truck 18 is equipped with a hoist and the associated electrical apparatus for operating the well casing perforation apparatus of this invention. A cable 20 extends from a hoist mounted within the truck provides electrical connection from equipment in the truck to the perforating apparatus as well as a physical support for the apparatus within the well. In the lower portion of the well that is cut away for illustration purposes the short tubing string 16 terminates at a bulkhead 22 and the longer tubing string 14 continues through this bulkhead to a lower portion of the well (not shown). The casing is separated into several segments within the well that are joined by casing and collars one of which is shown in the figure and identified at 24. The well casing perforation apparatus of this invention is shown in the lower portion of casing 10 below the longest tubing string 14. The perforation apparatus shown in FIG. 1 is representative of one of the several embodiments of this apparatus that will be described in the following.

Figure 2:
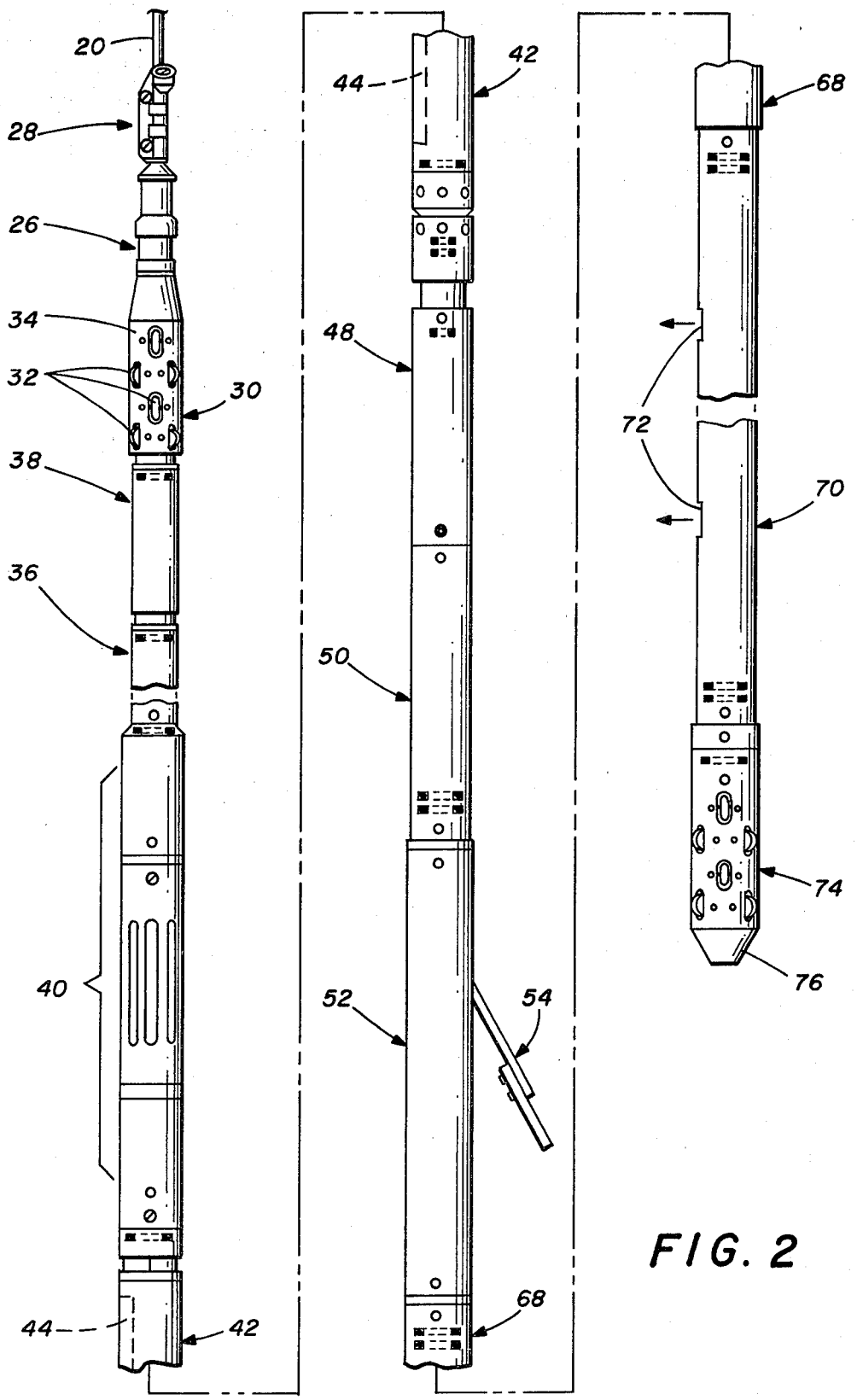
FIGS. 2, 3, 4 and 5 are sectional elevation views of three configurations of the well casing perforation apparatus of this invention.

Referring to FIG. 2 of the drawings the perforating apparatus shown therein is representative of one configuration of the perforating apparatus of this invention. The perforating apparatus contains a plurality of connectable and cooperatively operable subassemblies forming an elongated housing that is threadedly joined together into an operable piece of equipment for use. Beginning with the upper end portion of the apparatus, cable 20 is mounted with the housing at a cable head 26. A housing guide assembly 28 is mounted around cable 20 immediately above cable head 26. Housing guide assembly 28 is freely rotatedly mounted around the cable 20 and provided with a roller or wheel and a sliding shoe or guide portion which enables the housing to be pulled into a reduced diameter aperture such as when the housing is pulled from a lower portion of well casing through a bulkhead or the like into a shorter tubing string as is illustrated in FIG. 1. Guide assembly 28 prevents the the upper end portion of cable head 27 from becoming stuck or wedged against the obstruction created by a reduced diameter aperture within a well casing. Included with cable head 26 is upper roller assembly 30. Upper roller assembly 30 contains a plurality of individual rollers 32 mounted in a space relation around and longitudinally along this subassembly. Rollers 32 protrude from the outer surface 34 of the upper roller assembly housing in order to support the housing on the interior tubular surface presented by well casing and tubing. Rollers 32 in this roller assembly and likewise in other roller assemblies described in the following constructed with low friction bearings so that rotation of the rollers requires very little force. This construction assists in longitudinal movement of the housing through the tubing and casing of a well by significantly reducing the force required to accomplish such movement. Immediately below upper roller assembly 30 is a connecting segment 38 of cablehead 30. That joins a casing collar locator 36. Casing collar locator 36 is used to locate the collars within casing 10 of a well. In perforating operations it is typical to locate several collars within a well in order to determine the exact position of the zone of interest that is to be perforated prior to the actual perforation. It is also desirable to locate collars within the casing in order to position the perforating gun such that it will not attempt to perforate the casing through a collar.

Immediately below casing collar locator 36 is a swivel sub 40. Swivel sub 40 is constructed with overlapping internal and external members that provide for a rigid longitudinal connection between upper and lower portions of the housing while at the same time providing for free rotational movement between adjoining upper and lower portions of the housing.

Immediately below swivel sub 40 in the housing is an eccentrically weighted sub 42. Eccentric weight sub 42 contains a substantially dense weight that is positioned in an eccentric relation to the longitudinal axis of the housing. This eccentric weight is illustrated in dashed lines in its eccentric position relative to the longitudinal axis of this sub. The position of eccentric weight 44 is on what will be referred to as the bottom portion of the housing and the perforating gun apparatus. Due to the mass of weight 44 being selected as substantially larger than the mass of the adjacent portion of the perforating apparatus housing this weight will cause the housing to rotate to an orientation placing weight 44 in a downwardly oriented direction. This is facilitated by the presence of swivel sub 40. Immediately below eccentric weight sub 42 is an alignment joint sub indicated at 48. Alignment joint sub 48 is used to correctly connect eccentric weight sub 42 with the orienting apparatus and the casing perforating gun so that the bottom portion of the housing will align with outlets of the casing perforating gun and with opposite portions of the orientation apparatus or gun pointer. Alignment joint sub 48 has an adjustment device to provide for accurate relative positioning of these several components. Connection sub 50 contains a switch circuit which is operably connected with the gun pointer and the casing perforating gun. Immediately below connection sub 50 is orienting apparatus sub 52 which contains a gun pointer arm 54. Pointer arm 54 is pivotally mounted within the housing of this sub as shown in FIG. 7.

Figure 7:
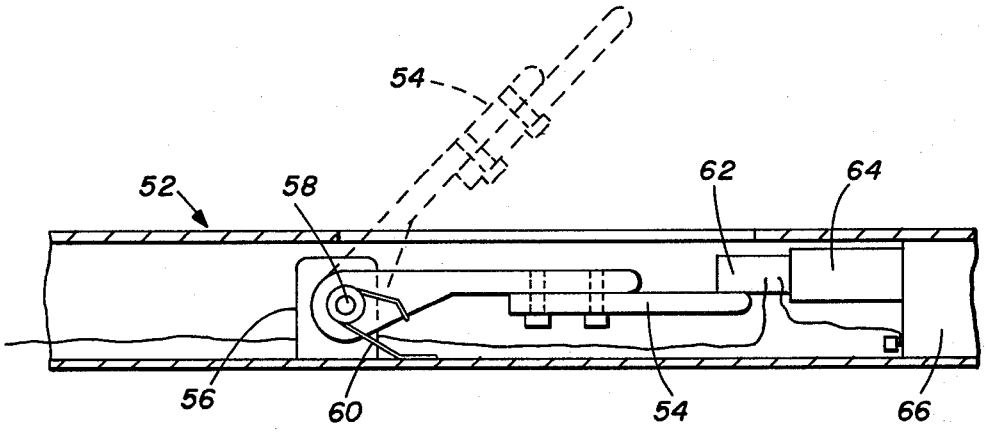
FIG. 7 is a cutaway view of the housing showing the pointer arm in a retracted and latched position in solid lines and in an extended position in dashed lines.

Briefly referring to FIG. 7 pointer arm 54 is mounted by a support block 56 and supported thereon by a pivot pin 58. A torsion spring 60 acts between an interior position of the housing and pointer arm 54 to urge the arm outward. Pointer arm 54 is retained in a retracted position as shown in solid lines in FIG. 7 by a squib.

Squib 62 is supported on a squib mount 64 and a plug 66 within the interior of the housing. Release of pointer arm 54 is achieved by the firing of squib 62 upon the receipt of an electrical command from the associated electrical equipment within service truck 18.

Returning to FIG. 2, immediately below orienting apparatus sub 52 is a connection sub 68 connecting orientor apparatus sub 52 with the casing perforating gun 70. Casing perforating gun 70 contains a plurality of explosive charges as is well known in the art which exit through apertures 72 in the outer wall of the associated housing to perforate the well casing. Arrows are shown at the apertures 72 indicating the direction in which the explosive charges are directed. Immediately below casing perforating gun 70 is a lower roller assembly 74 at the lower end portion of the housing. Lower roller assembly 74 is provided with a plurality of spaced apart rollers as described above with upper roller assembly 30. A pointed end cone 76 terminates the lower end portion of this housing.

Operation of the well casing perforating apparatus of this invention includes assembly of the elongated housing and its several component parts as illustrated in FIG. 2. The casing perforating gun 70 is supplied with five explosive charges and the orienting apparatus sub 52 has pointer arm 54 positioned in the retracted position and secured by squib 62. When this is complete perforating apparatus is positioned within the tubing string 16 and lowered into the well as the perforating apparatus moves through the tubing the rollers on the roller assemblies permit it to easily move through the tubing even considering the restriction provided by tubing that has the corkscrew configuration and the inclined postion offered by a deviated borehole. Swivel 40 allows rotation of the lower portion of the housing relative to the upper portion of the housing and thus enabling it to be oriented as illustrated in FIG. 1 as it moves through the tubing and also when it moves out of the tubing into the casing. Before actual perforation is performed, collar locator 36 is utilized to determine location of the perforating gun within the casing thereby determining the precise location at which the perforation is to take place.

Figure 6:
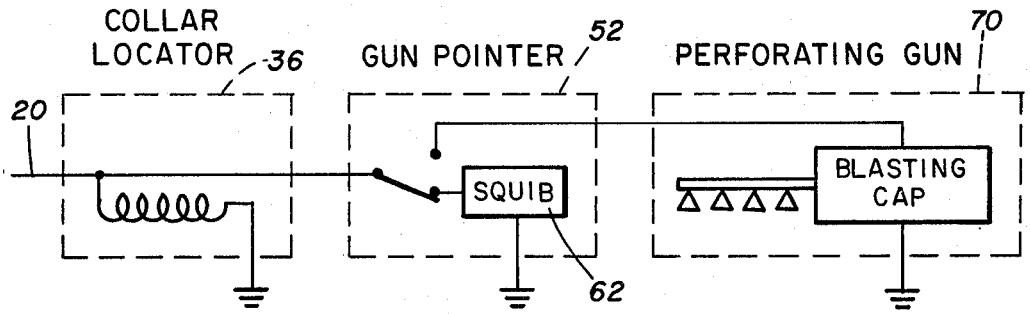
FIG. 6 is a block circuit diagram of the control circuit within the housing for the well casing perforation apparatus.

Referring to FIG. 6, the circuit shown in FIG. 6 illustrates diagramatically the electrical operation of the casing perforating apparatus. Casing collar locator 36 is connected to cable 20 and used as described for locating collar within casing 10. Gun pointer 52 and squib 62 are also connected electrically with cable 20. When the desired location at which the perforations are to be placed is located then squib 62 is fired. This releases pointer arm 54 from its retracted position within the housing and the pointer arm assumes an extended position as shown in FIGS. 1 and 2 and in the dashed lines of FIG. 7. As pointer arm 54 extends from the housing it will be pointing upward or oppositely relative to the outlets from casing perforating gun 70. A positioning switch illustrated in FIG. 6 is mechanically connected with pointer arm 54 such that it will enable perforating gun only when pointer arm 54 is fully extended. In the event that pointer arm strikes a longest string of tubing 14 it will not be fully extended and thus perforating gun 70 will be inoperative. In such event it is necessary to manipulate the perforating apparatus by raising and/or lowering such to displace pointer arm 54 from its restrained position. When this is done swivel 40 enables the lower portion of the perforating apparatus to rotate as is assisted by eccentric 44 and the roller assemblies. With pointer 54 in its fully extended position electrical connection from cable 20 is made to the blasting cap of perforating gun 70 thereby enabling an electrical signal from the equipment within the service truck 18 to actuate perforating gun 70 thereby perforating casing 10. At this point it is important to note because perforating gun 70 is not operable unless arm 54 is in its extended position this ensures that the discharge from casing perforating gun 70 will not be pointed at the longest tubing string 14 and thus will not damage it. In order to further ensure that casing perforating gun 70 is positioned correctly pointer arm 54 is strongly urged outward from the housing. This forces the bottom portion of the housing into firm contact with the interior of casing 10. Because pointer arm 54 strongly urges the housing against the interior of the casing, and because the perforating gun will not be electrically operable until pointer arm 54 is in its extended position essentially requires that pointer arm 54 be positioned in an adjacent relationship to longest tubing string 14 thus substantially eliminating the possibility of discharging perforating gun 70 at this tubing string.

The following portions of this description concern additional embodiments and/or configurations of the well casing perforating apparatus of this invention which function similarly to that described above and contain many of the same component parts. Therefore, in the following discussion similar components are provided with similar numbers to the components described above. The construction and function of all of the similarly identified components and this description is the same. Operationally the followingly described equipment configuration function the same as that described immediately above in regard to the perforating operations outlined and depicted in FIG. 1 therefore it will not be repeated.

Figure 3:
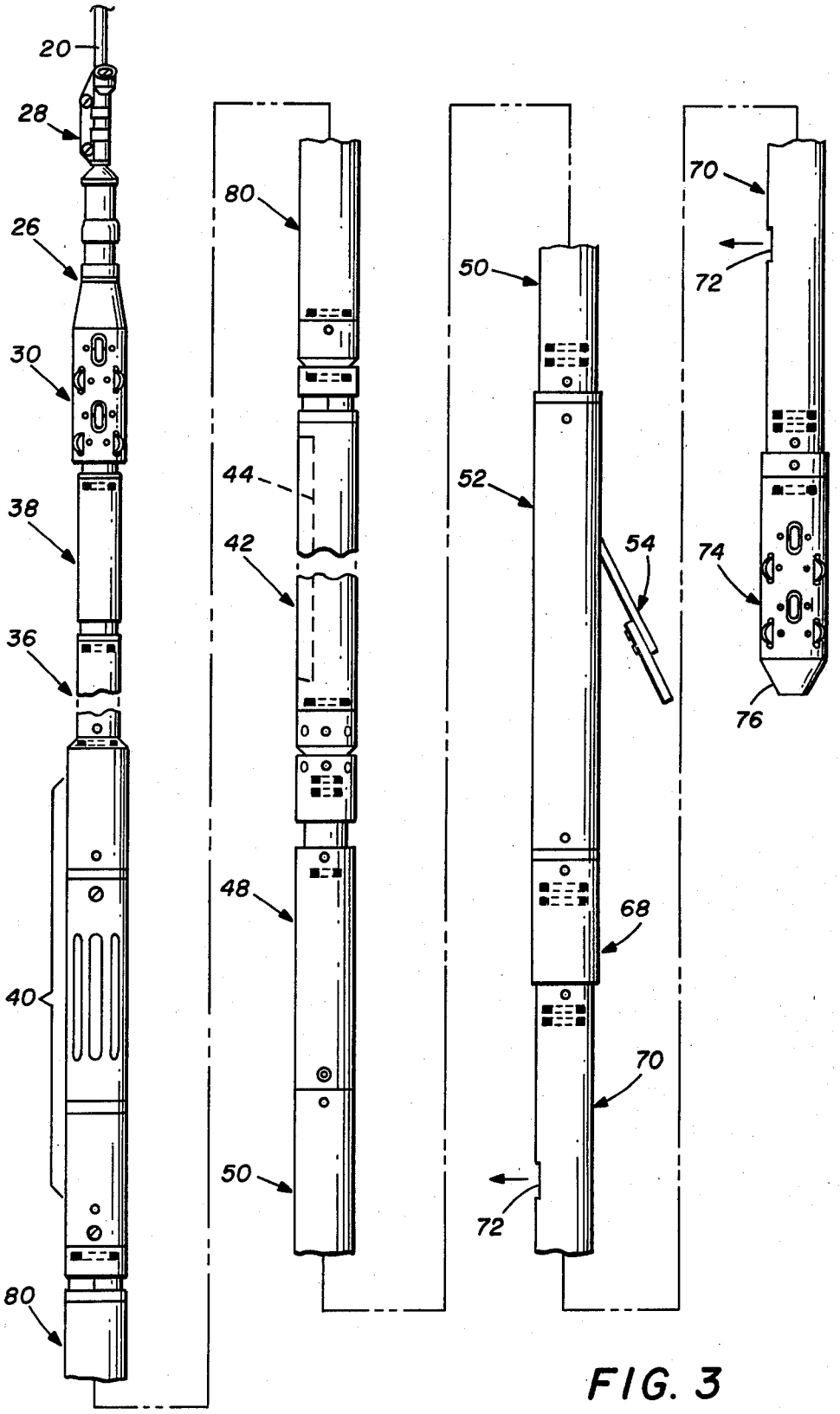

FIG. 3 shows another configuration of the well casing perforating apparatus of this invention. This configuration of the apparatus has the same components as are included in the apparatus shown in FIG. 2 and it additionally includes another weight or sinker bar sub 80 placed above eccentric weight sub 42 and alignment joint 48. Beginning at the upper end of the perforating apparatus shown in FIG. 3 it includes a housing guide assembly 28 secured around cable 20 above cable head 26. Cable head 26 (including upper roller assembly 30) being the top of the housing is followed by upper roller assembly 30, casing collar locator 36, swivel sub 40, auxiliary weight or sinker bar 80, eccentric weight sub 42, alignment joint 48, connection sub 50, orienting apparatus pointer arm 52, orienter connection sub 68, casing gun perforating gun 70 and lower roller assembly 74 and conical lower end 76. The addition of sinker bar sub 80 to the perforating apparatus functions to increase its effectiveness in passing through well tubing and casing due to the added mass of the equipment. This additional weight has been found helpful when moving the housing through tight spots in a well.

Figure 4:
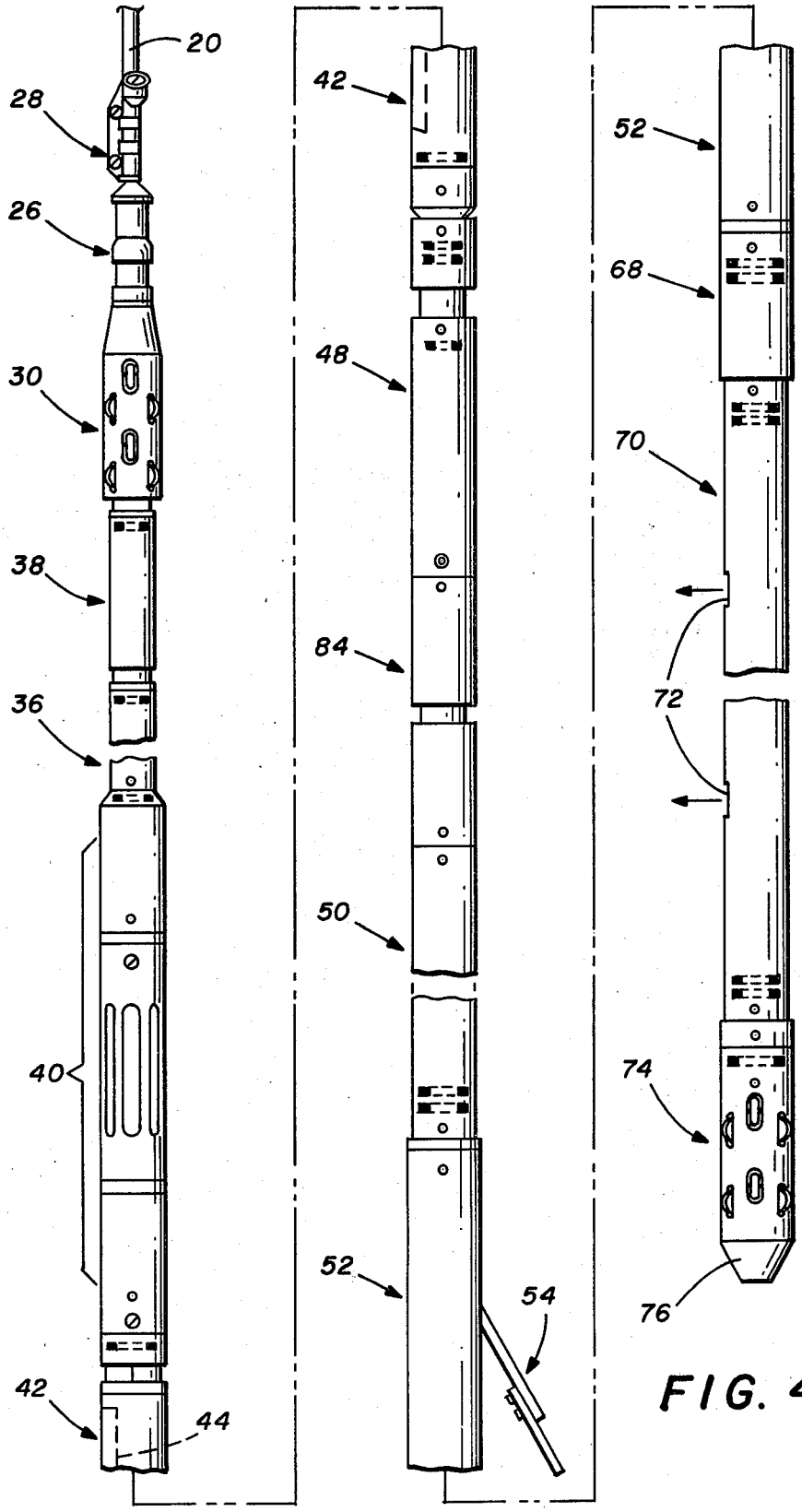

FIG. 4 illustrates an additional configuration of the the well casing perforating apparatus of this invention wherein it includes the functional sub assemblies of the apparatus shown in FIG. 2 and additionally includes a centrally disposed universal joint. Beginning at the upper end portion of the apparatus such includes housing guide assembly 28 above cable head 20 and mounted around cable 20. Cable head 26 being the top of the housing (and including upper roller assembly 30) is followed by connection sub 38, casing collar locator 36, swivel sub 40, eccentric weight sub or sinker bar 42, alignment joint 48, universal joint 84, connection sub 50, orienting apparatus sub 52, orienter connection sub 68, casing perforating gun 70, lower roller assembly 74, and conical lower end 76. Universal joint 84 includes upper and lower members that are joined by a movable coupling that will permit free swinging movement of the lower member relative to the upper member but will not permit relative rotation of the members. The non rotation of universal joint 84 is essential in order to align eccentric weight sub 42 with orienting apparatus sub 52 and perforating gun 70. The addition of universal joint 84 enables the casing perforating apparatus of this configuration to more easily pass through tubing strings and casings wherein the radius of curvature of them is relatively short. This feature is particularly significant when passing the perforating apparatus through tubing in a well with a highly deviated borehole because of the inherently shorter radius of curvature involved.

Figure 5:
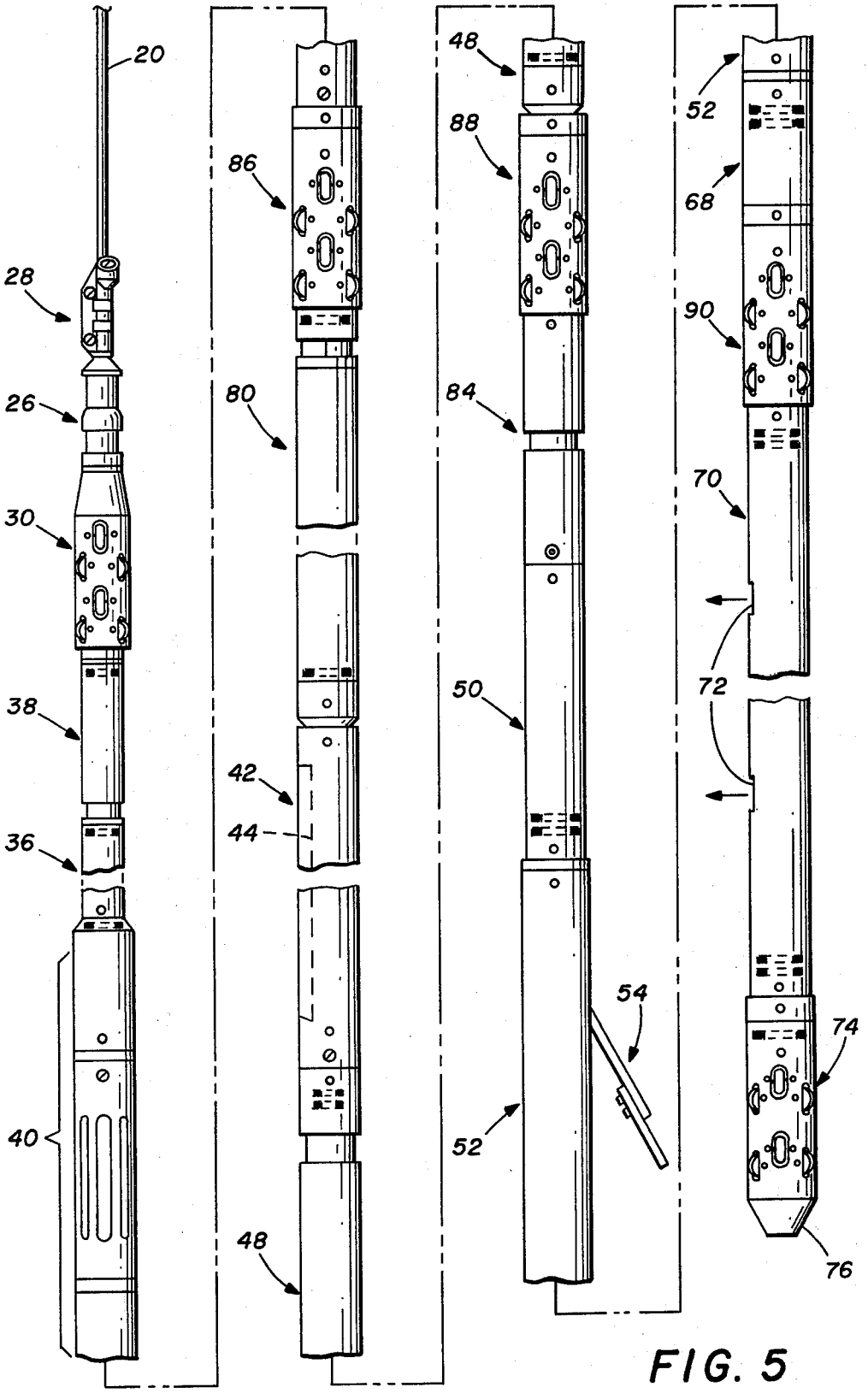

FIG. 5 illustrates yet another configuration of the well casing perforating apparatus of this invention. The apparatus shown in FIG. 5 includes a combination of all of the above described components. Beginning at the upper end of this apparatus cable 20 is mounted with cable head 26 and housing guide assembly 28 is positioned around the cable above the cable head. Cable head 26 with upper roller assembly 30 is followed by connection section 38, casing collar locator 36, swivel sub 40, a first mid roller assembly 86, sinker bar or weight sub 80, eccentric weight sub 42, alignment joint sub 48, a second mid roller assembly 88, universal joint 84, connection sub 50, orienting apparatus sub 52, orienter connection sub 68, a third mid roller assembly 90, casing perforating gun 70, lower roller assembly 74, and lower conical end 76. In this perforating apparatus the addition of the three roller assemblies through the mid portion of the housing assists its motion through tubing and casing by the roller assemblies being adjacent to the heavier components thereof thereby significantly reducing the opportunity for sliding friction to be encountered on the exterior of the housing. The addition of these roller assemblies and universal joint 48 provides increased maneuverability of the housing which is needed for motion through wells with highly deviated boreholes and through wells that may have twisted or corkscrew tubing.

It is to be understood that the specific combination of components as they are arranged in the several shown configurations of this well casing perforating apparatus can be repositioned relative to each other at the desire of the user. The illustrated position of the components in the apparatus is chosen for logical cooperation between them and ease in assembling the equipment. However, the user can adjust the relative position of some of the components in the mid portion of the equipment for adaptation for a specific situation or its individual desire without departing from the scope of this invention.

As will become apparent from the foregoing description of the applicant's perforating system and associated apparatus a relatively simple and effective means have been provided to transport a well casing perforating gun through tubing and casing within a well. The system functions to pass the perforating equipment through one string of tubing in a multiple string well, position it properly for perforation of the casing, and remove the perforating gun once the perforation has taken place. The apparatus in its several configurations is uniquely adapted for moving through twisted or corkscrew tubing and through wells with highly deviated boreholes. The apparatus has several features which assists its movements both into and out of such a well which was not possible with prior art configurations of equipment.

The embodiments of the invention in which an exclusive property or privilege is claimed are defined as follows:

1. A well casing perforating apparatus, comprising:

(a) an elongated cylindrically tubular housing connectable at an upper end portion to a cable for positioning the device in a well within the casing thereof;

(b) a housing guide means mounted at an upper end portion of said housing at said cable for guiding said housing upper end portion into an aperture within said casing that is smaller in dimension than said casing;

(c) an upper roller means at an upper end portion of said housing having a plurality of rollers mounted therearound said housing in a spaced relation and in fixed relative positions to reduce the friction incurred through longitudinal movement of said housing through said casing and the like, said roller means having an outer dimension substantially smaller than the interior of said well casing adapted to support said housing on the interior of a tubular support surface within said well;

(d) a casing perforating means within said housing having an explosive casing perforation charge;

(e) a casing perforating orienting means in said housing operably positioned relative to said perforating means and operable to orient said perforating means relative to an elongated body within the casing in which said housing is located such that said perforating means will not be oriented toward said elongated body;

(f) swivel means with said housing below said upper roller means and above said orienting means and said casing perforating means and adapted to permit free rotation of the portion of said housing located below said swivel means relative to the portion of said housing located above said swivel means;

(g) eccentric weight means contained within a segment said generally cylindrically tubular housing below said swivel means of having a weight substantially denser than other portions of the well casing perforating apparatus and positioned eccentrically relative to the transverse cross section of said generally cylindrically tubular housing and said weight being sufficiently large in mass to cause said housing to rotate axially when unrestrained with said weight being on the downwardly directed portion of said housing in order to urge the bottom of said housing in a downward direction; and (h) lower roller means on a lower end portion of said housing having a plurality of rollers mounted therearound said housing in a spaced relation and in fixed relative positions to decrease the associated friction accompanying longitudinal motion of said housing, said roller means having an outer dimension substantially smaller than the interior of said tubular support surfaces within said well casing adapted to support said housing on the interior of a a well.

2. The apparatus of claim 1, wherein said housing has a universal joint mounted in a mid-portion thereof to facilitate swinging motion of the portion of said housing below said universal joint relative to the portion of the housing above said universal joint while restraining such swinging motion with respect to relative rotation.

3. The well casing perforating apparatus of claim 1, wherein said housing has a mid-roller means mounted in a mid-portion of the longitudinal length thereof with said mid-roller means having a plurality of rollers therearound in spaced relation to support said housing on the interior of a tubular support surface within said well.

4. The well casing perforating apparatus of claim 1, wherein an interlock means is contained within said housing and operatively coupled to said casing perforating orienting means and said casing perforating means and operable to permit actuation of said casing perforating means only when said perforating orienting means has operationally provided an indication that said perforating means will not be oriented toward said elongated body.

5. The well casing perforating apparatus of claim 1, wherein an auxiliary weight is mounted with said housing in order to provide additional mass to said apparatus for assisting in downward motion through a well.

6. A well perforating system for perforating a casing in a well having multiple zones of production and having multiple strings of tubing installed therein wherein said system includes:

(a) a hoist means for supporting on a cable a perforating apparatus for traversing it through one of the tubing strings within a well;

(b) control means operable with said hoist means to actuate a well casing perforating means and associated apparatus;

(c) a well casing perforating apparatus having:

(i) an elongated generally cylindrically tubular housing at an upper end portion to said cable;

(ii) housing guide means mounted at the upper end portion of said housing at said cable for guiding said housing upper end portion into the lower end portion of a tubing string within said well;

(iii) a roller means at an upper end portion of said housing and a separate roller means at a lower end portion of said housing with each roller means having a plurality of rollers mounted therearound said housing in a spaced relation and in fixed relative positions to each other and additionally having an outer dimension substantially smaller than a tubular support surface in said well adapted to support said housing on the interior of a tubular support surface within said well;

(iv) a casing perforating means within said housing adapted to perforate said casing along a side portion said housing;

(v) a casing perforating orienting means operable to orient said perforating means relative to a string of tubing within the casing such that said perforating means will not be oriented toward said string of tubing when actuated;

(vi) swivel means with said housing above said orienting means and said casing perforating means adapted to permit free relative rotation between the portions of said housing above and below said swivel means; and (vii) eccentric means in said housing below said swivel means including a weight eccentrically located relative to the longitudinal center of said housing to cause axial rotation of said housing when substantially unrestrained, said weight being positioned in axial alignment with outlets of said casing perforating means.

7. The well perforating system of claim 6, wherein said housing has a universal joint in a mid-portion thereof connecting upper and lower portions of said housing and permitting free swinging movement of said housing end portions relative to each other and preventing in relative rotation thereof in order to assist said well casing perforating apparatus in longitudinal movement through curved tubing.

8. The well perforating system of claim 6, wherein said housing has an additional roller means mounted in a mid-portion thereof with a plurality of rollers mounted in a spaced relation therearound to support said housing on the interior of a tubular support surface within a well.

9. The well perforating system of claim 6, wherein said housing has an interlock means cooperatively operable with said casing perforating orienting means and said casing perforating means in order to enable said casing perforating means for operation only when said orienting means indicates that said perforating means is not oriented toward a tubing string within said casing.

10. The well perforating system of claim 6, wherein said housing has an additional weight means mounted therein to provide additional mass to said well casing perforating apparatus to assist in passing through said tubing string and casing.

11. The well perforating system of claim 6, wherein said well casing perforating apparatus has a casing collar locator operator with said control means to indicate the presence of collars in the casing string of a well for positioning of said casing perforating means at a location distant from a casing collar.

12. The well perforating system of claim 6, wherein said casing perforating orienting means has an arm mounted in said housing and extendable therefrom upon command from said control means to contact the interior of a well casing to urge said housing against the interior wall of the well casing and to displace said housing in an opposite relation to a tubing string in the well casing.

13. A well casing perforating apparatus, comprising:

(a) an elongate generally cylindrically tubular housing having a cable head at an upper end portion to attach a cable to the housing for use in positioning the device in a well within the casing thereof;

(b) a housing guide means mounted around the cable above said cable head for guiding said housing upper end portion into an aperture within said casing that is smaller in dimension than said casing;

(c) an upper roller means mounted below said cable head and having a plurality of rollers mounted therewith around said housing in a spaced relation and in fixed relative positions to contact and roll on the interior of a tubular member;

(d) a casing collor locator means mounted below said upper roller means and electrically connected to a cable mounted with said cable head and operable to indicate the presence of collars in a string of well casing;

(e) swivel means with said housing below said upper roller means and having operably coupled upper and lower members adapted to permit free rotation of the portion of said housing located below said swivel means relative to the portion of said housing located above said swivel means;

(f) eccentric weight means contained within a segment of said generally cylindrically tubular housing below said swivel means having a weight substantially denser than other portions of the well casing perforating apparatus and positioned eccentrically relative to the transverse cross section of said generally cylindrically tubular and said weight being sufficiently large in mass to cause said housing to rotate axially when unrestrained with said weight being on the downwardly directed portion of said housing in order to urge the bottom side portion of said housing in a downward direction;

(g) an alignment means mounted below said eccentric weight means including a rotationally selectively securable joint between adjoining housing members permitting the relative rotational positioning of these adjoining housing members and the securing of these said housing members in a fixed position;

(h) a casing perforating gun orienting means mounted below said alignment means and positioned relative to said eccentric weight means to orient said housing in an opposite relation to an elongated body located within well casing in which said housing is located such that a bottom side portion of said housing is in opposed relation to said elongated body;

(i) a casing perforating means mounted below said casing perforating gun orienting means within said housing and having a casing perforating gun with an explosive casing perforating charge operable to perforate said casing; and (j) lower roller means mounted below said casing perforating means at the lower end portion of said housing having a plurality of rollers mounted in spaced relation therearound and in fixed relative positions to contact and roll on the interior of a tubular member to support said housing on the interior of a tubular support surface within a well.

14. A well casing perforating apparatus, comprising:

(a) an elongate generally cylindrically tubular housing having a cable head at an upper end portion to attach a cable to the housing for use in positioning the device in a well within the casing thereof;

(b) a housing guide means mounted around the cable above said cable head for guiding said housing upper end portion into an aperture within said casing that is smaller in dimension than said casing;

(c) an upper roller means mounted below said cable head and having a plurality of rollers mounted therewith around said housing in a spaced relation and in fixed relative positions to contact and roll on the interior of a tubular member;

(d) a casing collar locator means mounted below said upper roller means and electrically connected to a cable mounted with said cable head and operable to indicate the presence of collars in a string of well casing;

(e) swivel means with said housing below said upper roller means and having operably coupled upper and lower members adpated to permit free rotation of the portion of said housing located below said swivel means relative to the portion of said housing located above said swivel means;

(f) an additional weight means mounted with said housing below said swivel means;

(g) eccentric weight means contained within a segment of said generally cylindrically tubular housing below said swivel means and having a weight substantially denser than other portions of the well casing perforating apparatus and positioned eccentrically relative to the transverse cross section of said housing and said weight being sufficiently large in mass to cause said housing to rotate axially when unrestrained with said weight being on the downwardly directed portion of said housing in order to urge the bottom side poriton of said housing in a downward direction;

(h) a mid roller means mounted around said housing below said eccentric weight means and having a plurality of rollers mounted in a spaced relation around said housing to contact and roll on the interior of a tubular member;

(i) an alignment means mounted below said eccentric weight means including a rotationally selectively securable joint between adjoining housing members permitting the relative rotational positioning of these adjoining housing members and the securing of these said housing members in a fixed position;

(j) a casing perforating gun orienting means mounted below said alignment means and positioned relative to said eccentric weight means to orient said housing in an opposite relation to an elongated body located within well casing in which said housing is located such that a bottom side portion of said housing is in opposed relation to said elongated body;

(k) a casing perforating means mounted below said casing perforating gun orienting means within said housing and having a casing perforating gun with an explosive casing perforating charge operable to perforate said casing;

(l) lower roller means mounted around said housing below said casing perforating means at the lower end portion of said housing having a plurality of rollers mounted in spaced relation therearound and in fixed relative positions to contact and roll on the interior of a tubular member to support said housing on the interior of a tubular support surface within a well; and (m) an interlock means is contained within said housing and operatively coupled to said casing perforating gun orienting means and said casing perforating means and operable to permit actuation of said casing perforating means only when said casing perforating orienting means has opertionally provided an indication that said perforating means will not be oriented toward an elongated body.

15. A well casing perforating apparatus, comprising:

(a) an elongate generally cylindrically tubular housing having a cable head at an upper end portion to attach a cable to the housing for use in positioning the device in a well within the casing thereof;

(b) a housing guide means mounted around the cable above said cable head for guiding said housing upper end portion into an aperture within said casing that is smaller in dimension than said casing;

(c) an upper roller means mounted below said cable head and having a plurality of rollers mounted therewith around said housing in a spaced relation and in fixed relative positions to contact and roll on the interior or a tubular member;

(d) a casing collar locator means mounted below said upper roller means and electrically connected to a cable mounted with said cable head and operable to indicate the presence of collars in a string of well casing;

(e) swivel means with said housing below said upper roller means and having operably coupled upper and lower members adpated to permit free rotation of the portion of said housing located below said swivel means relative to the portion of said housing located above said swivel means;

(f) eccentric weight means contained within a segment of said generally cylindrically tubular housing below said swivel means and having a weight substantially denser than other portions of the well casing perforating apparatus and positioned eccentrically relative to the transverse cross section of said housing and said weight being sufficiently large in mass to cause said housing to rotate axially when unrestrained with said weight being on the downwardly directed portion of said housing in order to urge the bottom side portion of said housing in a downward direction;

(g) a universal joint means mounted below said eccentric weight means having a connecting joint to facilitate swinging motion of the portion of said housing below said universal joint means relative to the portion of the housing above said universal joint means while restraining such motion with respect to relative rotation;

(h) a mid-roller means mounted around said housing below said universal joint means and having a plurality of rollers therearound said housing in spaced relation to support said housing on the interior of a tubular support surface;

(i) an alignment means mounted below said eccentric weight means including a rotationally selectively securable joint between adjoining housing members permitting the relative rotational positioning of these adjoining housing members and the securing of these adjoining housing members and the securing of these said housing members in a fixed position;

(j) a casing perforating gun orienting means mounted below said alignment means and positioned relative to said eccentric weight means to orient said housing in an opposite relation to an elongated body located within well casing in which said housing is located such that a bottom side portion of said housing is in opposed relation to said elongated body;

(k) a casing perforating means mounted below said casing perforating gun orienting means within said housing and having a casing perforating gun with an explosive casing perforating charge operable to perforate said casing;

(l) lower roller means mounted around said housing below said casing perforating means at the lower end portion of said housing having a plurality of rollers mounted in spaced relation therearound and in fixed relative positions to contact and roll on the interior of a tubular member to support said housing on the interior of a tubular support surface within a well; and (m) an interlock means is contained within said housing and operatively coupled to said casing perforating gun orienting means and said casing perforating means and operable to permit actuation of said casing perforating means only when said casing perforating orienting means has operationally provided an indication that said perforating means will not be oriented toward an elongated body.

16. A well casing perforating apparatus, comprising:

(a) an elongate generally cylindrically tubular housing having a cable head at an upper end portion to attach a cable to the housing for use in positioning the device in a well within the casing thereof;

(b) a housing guide means mounted around the cable above said cable head for guiding said housing upper end portion into an aperture within said casing that is smaller in dimension than said casing;

(c) an upper roller means mounted below said cable head and having a plurality of rollers mounted therewith around said housing in a spaced relation and in fixed relative positions to contact and roll on the interior of a tubular member;

(d) a casing collar locator means mounted below said upper roller means and electrically connected to a cable mounted with said cable head and operable to indicate the presence of collars in a string of well casing;

(e) swivel means with said housing below said upper roller means and having operably coupled upper and lower members adapted to permit free rotation of the portion of said housing located below said swivel means relative to the portion of said housing located above said swivel means;

(f) a first roller means mounted below said swivel means having a plurality of rollers mounted in a spaced relation therearound to support said housing on the interior of a tubular support surface;

(g) eccentric weight means contained within a segment of said generally cylindrically tubular housing below said swivel means and having a weight substantially denser than other portions of the well casing perforating apparatus and positioned eccentrically relative to the transverse cross section of said housing and said weight being sufficiently large in mass to cause said housing to rotate axially when unrestrained with said weight being on the downwardly directed portion of said housing in order to urge the bottom side portion of said housing in a downward direction;

(h) an auxiliary weight means mounted below said eccentric weight means in order to provide additional mass to said housing for assisting in downward motion through a well;

(i) a mid-roller means mounted around said housing below said auxiliary weight means having a plurality of rollers therearound in spaced relation to support said housing on the interior of a tubular support surface;

(j) a universal joint mounted in a mid-portion thereof to facilitate swinging motion of the portion of said housing below said universal joint relative to the portion of the housing above said universal joint while restraining such motion with respect to relative rotation;

(k) an alignment means mounted below said eccentric weight means including a rotationally selectively securable joint between adjoining housing members permitting the relative rotational positioning of these adjoining housing members and the securing of these said housing members in a fixed position;

(l) a casing perforating gun orienting means mounted below said alignment means and positioned relative to said eccentric weight means to orient said housing in an opposite relation to an elongated body located within well casing in which said housing is located such that a bottom side portion of said housing is in opposed relation to said elongated body;

(m) a casing perforating means mounted below said casing perforating gun orienting means within said housing and having a casing perforating gun with an explosive casing perforating charge operable to perforate said casing;

(n) lower roller means mounted around said housing below said casing perforating means at the lower end portion of said housing having a plurality of rollers mounted in spaced relation therearound and in fixed realtive positions to contact and roll on the interior of a tubular member to support said housing on the interior of a tubular support surface within a well; and (o) an interlock means cooperatively operable with said casing perforating orienting means and said casing perforating means in order to enable said casing perforating means for operation only when said casing perforating gun orienting means indicates that said perforating means is not oriented toward a tubing string within said casing.

* * * * *